United States Patent [19]

Morell et al.

[11] Patent Number: 4,712,315

[45] Date of Patent: Dec. 15, 1987

[54] SKI BOOT

[75] Inventors: Joseph Morell, Annecy; Roland Petrini, Chambery, both of France

[73] Assignee: Salomon S. A., Annecy Cedex, France

[21] Appl. No.: 767,310

[22] Filed: Aug. 19, 1985

[30] Foreign Application Priority Data

Aug. 17, 1984 [FR] France ..... 84 13152

[51] Int. Cl.[4] ..... A43B 5/04

[52] U.S. Cl. ..... 36/117; 36/121

[58] Field of Search ..... 36/117–121

[56] References Cited

U.S. PATENT DOCUMENTS

| | | | |
|---|---|---|---|
| 3,868,783 | 3/1975 | Caporicci | 36/120 |
| 4,095,356 | 6/1978 | Robran et al. | 36/121 |
| 4,381,613 | 5/1983 | Lederer | 36/121 |
| 4,461,103 | 7/1984 | Annovi | 36/121 |
| 4,470,206 | 9/1984 | Annovi | 36/121 |
| 4,601,117 | 7/1986 | Leonardi | 36/120 |

FOREIGN PATENT DOCUMENTS

| | | | |
|---|---|---|---|
| 3044052 | 6/1982 | Fed. Rep. of Germany . | |
| 2100490 | 3/1972 | France . | |
| 2278280 | 2/1976 | France . | |
| 2416661 | 9/1979 | France . | |
| 2495901 | 6/1982 | France . | |
| 2342040 | 1/1983 | France . | |
| 2539278 | 7/1984 | France | 36/117 |
| 2555418 | 5/1985 | France | 36/117 |
| 2557776 | 7/1985 | France | 36/117 |

*Primary Examiner*—James Kee Chi

*Attorney, Agent, or Firm*—Pollock, Vande Sande & Priddy

[57] ABSTRACT

Device for controlling the flexion stiffness of a ski boot comprising a shell base (1) and an upper composed at least of a cuff (3). The device comprises a flexion element (9) arranged in a longitudinal direction between the shell base (1) and the cuff (3) attached (10) at one end on the shell base (1) or the cuff (3) and whose other end cooperates in movable contact with a ramp (11) carried by the cuff (3) or the shell base (1), respectively. A device (15) permits the flexion element (9) to be tightened in an adjustable manner in order to charge its change its characteristics, so as to adjust the stiffness of the articulation (5) of the cuff (3) on the shell base (1) and its progressivity as a function of the wishes of the skier and the actual conditions encountered in the run.

27 Claims, 21 Drawing Figures

COUPE $A^1A^1$

COUPE $A^2A^2$

COUPE A A

SKI BOOT

FIELD OF THE INVENTION

The present invention relates to boots for the practise of downhill skiing, of the type comprising a rigid shell surmounted by an upper surrounding the base of the leg.

BACKGROUND OF THE INVENTION

In such boots, normally of molded plastic material, the upper may comprise several parts: cuff, rear cover, eventually articulated on the base of the shell about a transverse axis. An axis of articulation may, depending on the case, not exist as such, but the upper should flex relatively to the base of the shell at least to a certain extent according to the conditions of use, and this is the equivalent of articulation.

The general direction of the upper, called "the axis of the upper" for the sake of simplicity, is forwardly inclined with respect to the vertical, with which the base of the shell is fast, by a certain angle called "advanced angle." This advanced angle is subject to variation around an average value according to the momentary circumstances of use as a result of the articulation of the upper on the base of the shell. In the assembly, the more the skier is at a high level, and works in a very flexed position, the more he desires a large average advanced angle (static); this could be of the order of 13° to 20° and sometimes could even reach 25°, while for less advanced skiers an angle of 8° to 15° is generally deemed optimal. Moreover, depending on the discipline practised and the condition of the snow, the skier desires more or less flexibility in the articulation of the upper on the base of the shell, i.e., facility for variation of the advanced angle under the effect of stresses. Thus a rather pronounced stiffness is preferred for competition, on hard snow or on ice, and sufficient flexibility on powder snow, in order to determine one's bearings, and during descent in order to arrange the musculature and to seek the flat ski position.

These considerations translate into the fact that, more and more frequently, skiers feel the need for boots not only characterized by an average advanced angle corresponding to their personal criteria, but also having a stiffness of the articulation of the upper on the base of the shell which increases as a function of the stress which they exert on the upper, in the direction of comfort and safety of the users.

It has therefore been sought to satisfy these requirements by devices allowing control of this flexion property. Numerous proposals have been made.

Among the devices known in the prior art, certain ones, like those described, e.g., in French Patent No. 2,100,490 or French Patent Application No. 2,416,661, comprise a damping device with a single- or double-acting spring anchored between a central point located in high position on the front of the cuff and a central point located toward the front of the foot on the rigid shell, or fast therewith. Apart from the very unaesthetic appearance of these devices, they are very awkward and exposed to shocks and untimely hooking during skiing maneuvres. They could thus represent a certain danger, and their reliability is quite uncertain.

In French Patent Application No. 2,278,280, there is proposed a device which could play the expected part in an accessory and partial manner. But this involves mainly connecting elements movable between the rigid shell and the cuff itself, confused with what, in the field of interest here, would be a rear cover, because the entry into the boot proceeds from the front. In fact, this device located at the rear of the boot merely makes up, by its flexibility, for the absence of articulation about a transverse axis of the cuff on the rigid shell. The proposed solution is thus outside the technical field of the present invention.

The two preceding devices operate only in or approximately in a vertical longitudinal plane without concerning the important zone which constitutes the bending fold and the kick zone of the foot.

One may further cite, among many others, the contribution of German Published Application No. 3,044,052 which has something in common with the spring device anchored at two points already mentioned above, and that of French Patent Application No. 2,495,901 where a double flexion plate is also anchored at two end points.

An original solution is also proposed by French Patent Application No. 2,342,040 in which an elongated support element is fixed by one part on the stop before binding of the boot and having at its other end a projecting part introduced between two adjustable buckles in position on the boot, for the purpose of limiting the advanced position of the upper of the boot.

In all cases, the proposed solutions, whose very profusion shows the importance and the difficulty of the problem to be solved, present at least one and generally several major inadequacies: poor or questionable effectiveness of the device, complexity leading to prohibitive cost, limitation only of the projection or maximal flexion of the upper, eventual adjustment made once and for all before the run, causing a lack of progressiveness in its effects and inadequacy with respect to the actual conditions of such run.

SUMMARY OF THE INVENTION

The present invention seeks to overcome these disadvantages by proposing a device providing the ski boot with characteristics of flexion of the upper with respect to the base of the shell which are effectively adjustable according to the needs of the skier prior to the run, and which have a real progressivity controlled by the actual momentary conditions of the run, all while preventing extreme flexions which would exceed the possibilities of the anatomy of the connection of the base of the leg to the foot, and providing damping of flexion forces sustained by a flexible return which remains sufficient for the lesser amplitude pulls.

BRIEF DESCRIPTION OF THE DRAWINGS

The technical characteristics of the invention which are the object of the claims, as well as certain other aspects and advantages, will appear in the light of the description which follows and for a comprehension of which reference is to be made to the drawings, in which:

DETAILED DESCRIPTION

Figure 1:
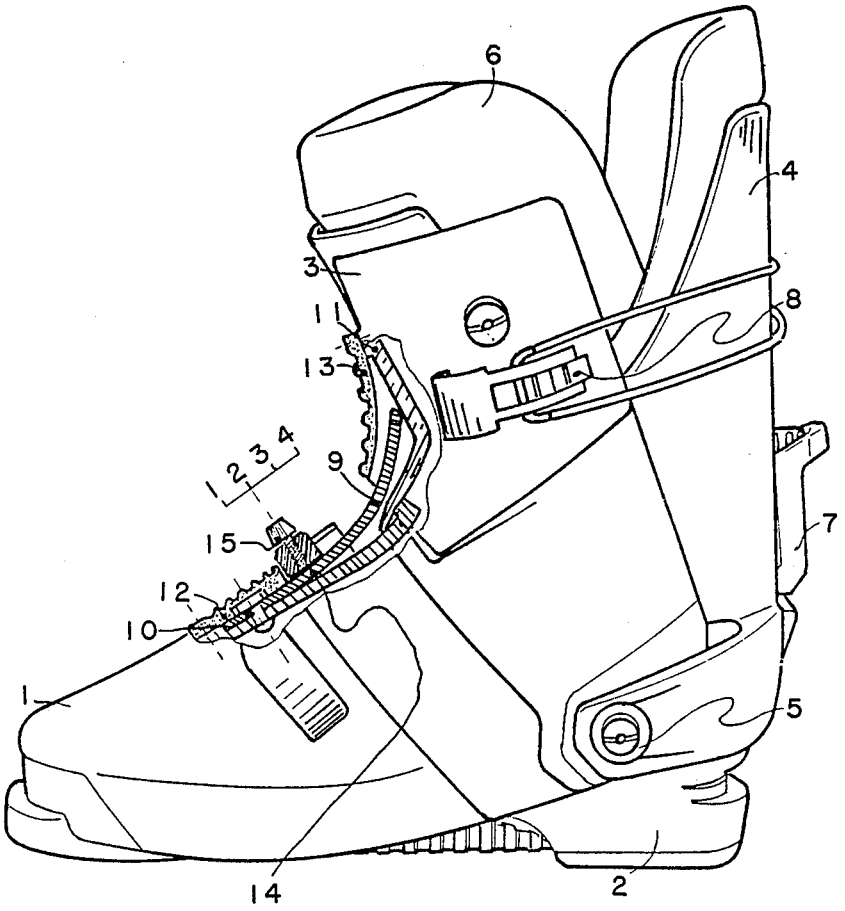
FIG. 1 shows a boot with, in partial section, an embodiment of the device according to the invention with which it is equipped.

Although the device according to the invention does not necessarily apply exclusively to this type of boot, the drawings intended to illustrate it, in FIGS. 1, 2, 4, 5 and 6, represent a boot of the conventional type called rear entry or opening.

The illustrated boot comprises, in known fashon, a rigid shell base 1 carrying a sole 2. An upper composed of a cuff 3 and a rear hood 4 partially covers with its lower portion the shell base 1 on which it is articulated about a transverse axis 5. The upper and the shell base 1 house an interior slipper 6. A lever 7 for internal tightening of the foot in the boot and a device 8 for closure on the bottom of the leg, of conventional lever and rack construction, are also shown.

As already mentioned, the advance angle of the upper, determined at rest by the construction of the boot, varies during use as a function of the pulls that the leg of the skier imposes on the upper, which can turn about the axis of articulation 5 on the shell base 1, and it is desirable that an opposing pull, increasing at the same time as the advance angle, counters this rotation so as to return the upper toward its rest position.

This result is attained by locating between the cuff 3 and the shell base 1 a resilient element acting as a spring. According to the invention, this spring is constituted by a flexion element 9 of longitudial direction anchored by an end either on the cuff 3 or on the shell base 1, and cooperating through contact at its other end either with the shell base 1 or with the cuff 3 through the intermediary of a cam ramp or track 11 transmitting to the element 9 the flexion forces. Through the selection of the anchoring or embedding point and of the profile of the ramp 11, one obtains the desired progressivity for the flexion stiffness of the upper as a function of the intensity of the momentary pull and the momentary advance angle.

Various forms for the flexion element 9, for the arrangement of the anchoring or embedding of the element 9 and for the ramp 11, as well as adjustment means acting on one or the other of these elements, can be adopted.

In the embodiment shown in FIG. 1, the flexion element takes the form of a flexion strip 9. It is anchored at 10, for example by riveting, resulting in a true embedding, in front of the kick zone of the foot on the shell base 1 at its front end. Its free rear end cooperates by positive contact with a ramp 11 solid with the cuff 3 and on which it can slide and whose profile in section is determined by the characteristics of the desired stiffness and their evolution as a function of the advance of the upper.

Preferably, the anchoring zone 10 on the shell base 1 and the region carrying the ramp 11, of the cuff 3, are protected by separate hoods 12, 13 playing the part both of protection and aesthetics of the general line of the boot.

Independently of the law of evolution of the stiffness of the articulation of the upper, one may desire, according to the wishes of the skier or the particular features of the intended run, to adjust the order of intensity of these. This can be done through an adjustment in longitudinal position of the effective point 14 of attachment or tightening of the flexion strip 9 on the shell base 1. Thus, FIG. 1 shows a screw-nut slide device 15 which is displaceable and can be stopped at several positions (1, 2, 3, 4) longitudinally on the hood 12 and which is able to positively pinch the flexion strip 9 against the subjacent shell base 1. This adjustment acts on the stiffness of the flexion strip 9 by causing a change in its point of impaction, and hence the effective length of the arm of the flexion lever.

Figure 2:
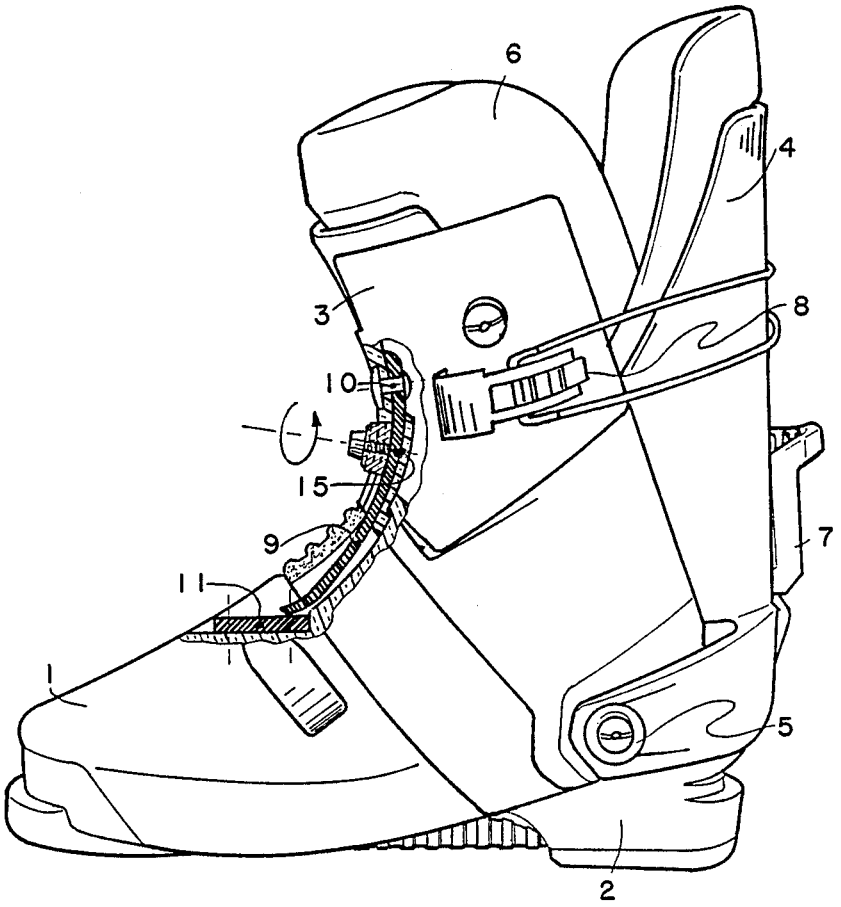
FIG. 2 shows a second embodiment of the invention.

In a related embodiment, shown in FIG. 2, the anchoring point 10 of the flexion strip 9 is located on the cuff 3 and the cam ramp or track 11 on the shell base 1. The arrangement of these different elements constituting the device is obviously different from that of the preceding case, but the operation and the possibilities of adjustment remain fundamentally the same, and all further comment is therefore superfluous for those skiled in the art.

Figure 3:
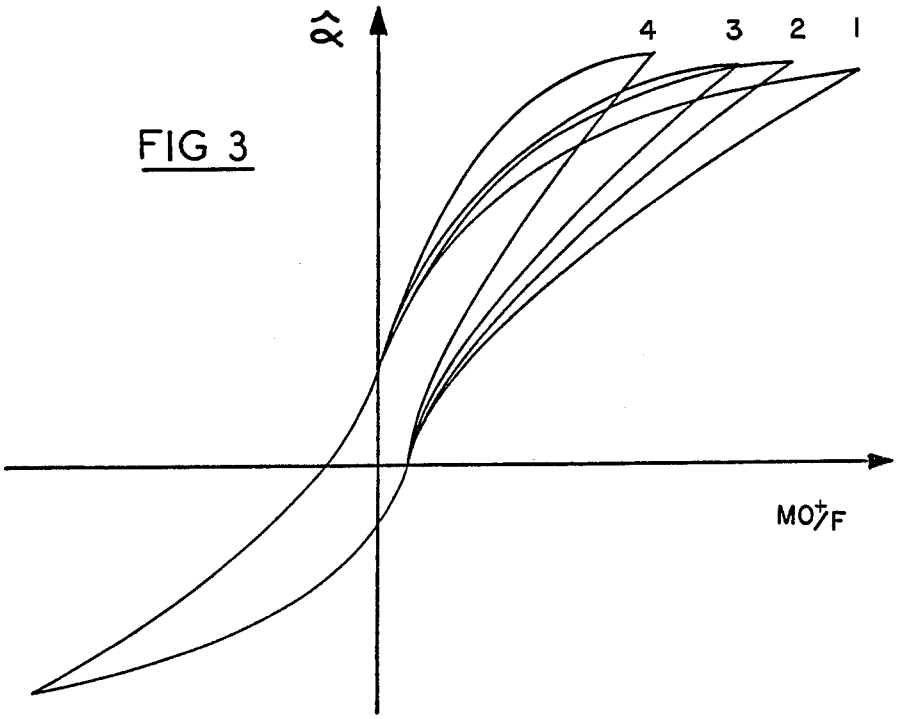
FIG. 3 is a diagram showing the flexion curves obtained for several adjustments with the preceding devices shown in FIGS. 1 and 2.

Flexion curves translating the development of the stiffness of the articulation 5 of the cuff 3 on the shell base 1 as a function of the adjustment positions (1, 2, 3, 4) discussed above are shown in FIG. 3. It can be seen that, for each adjustment, the invention makes it possible to obtain a great progressivity during operation in the stiffness of the boot, thereby giving the skier a better perception of the conditions for handling the ski, and therefore better control of the same and increased security and comfort. Besides, the different curves convey the tremendous range of stiffness intensities available to the skier. It is also to be noted that movable and interchangeable ramps 11 of different profiles can be provided without major problems, making it possible to further influence the progressivity characteristics of the stiffness, represented by the curves 1, 2, 3, 4 which are a function of the flexion angle $\alpha$ and of the flexion MOt/F of the upper of the boot.

Figure 4:
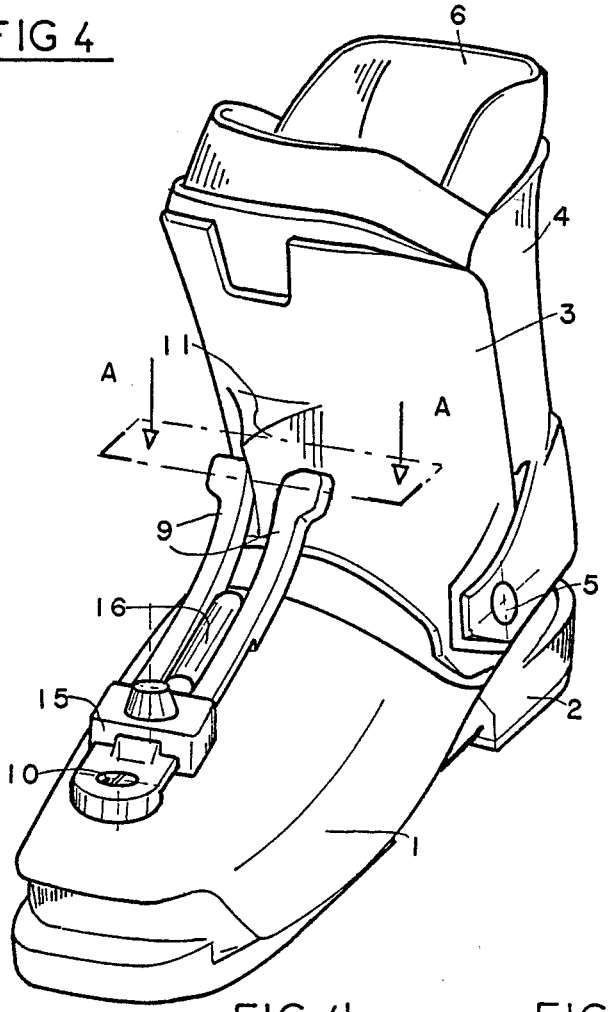
FIG. 4 shows a third embodiment of the invention, and FIGS. 4*a*, 4*b* and 4*c* profile sections according to plane A—A.

In the embodiment of FIG. 4, the flexion element 9 is represented in the form of a double tuning fork piece attached 10 by its base on the shell base 1 in front of the kick zone of the foot. The ends of the two tines of the tuning fork cooperate by movable contact with a cam or ramp surface 11 whose form, in guiding it, permits a sliding like the preceding in the longitudinal direction, but also in a transverse direction, the branches of the tuning fork drawing apart or together reesiliently also in flexion under the contact pressure brought to bear on their ends by the flanks of the cam surface 11. Depending on the desired shapes of the development curves of the flexion characteristics, the sectional profile of the cam surface 11 can be selected in appropriate manner.

Figure 4A:
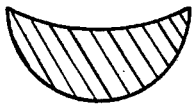
Figure 4B:
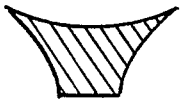
Figure 4C:
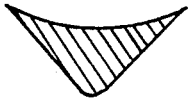

Thus, FIGS. 4*a*, 4*b* and 4*c* show such profiles different from that which is represented in FIG. 4.

Here again, it is also possible to change the effective attachment position, and hence the base of the tuning fork member, by means, for example, of a sliding adjustment device 15 pinching the two branches of the flexion element 9 against a longitudinal abutment fixed 16 on the shell base 1.

Figure 5:
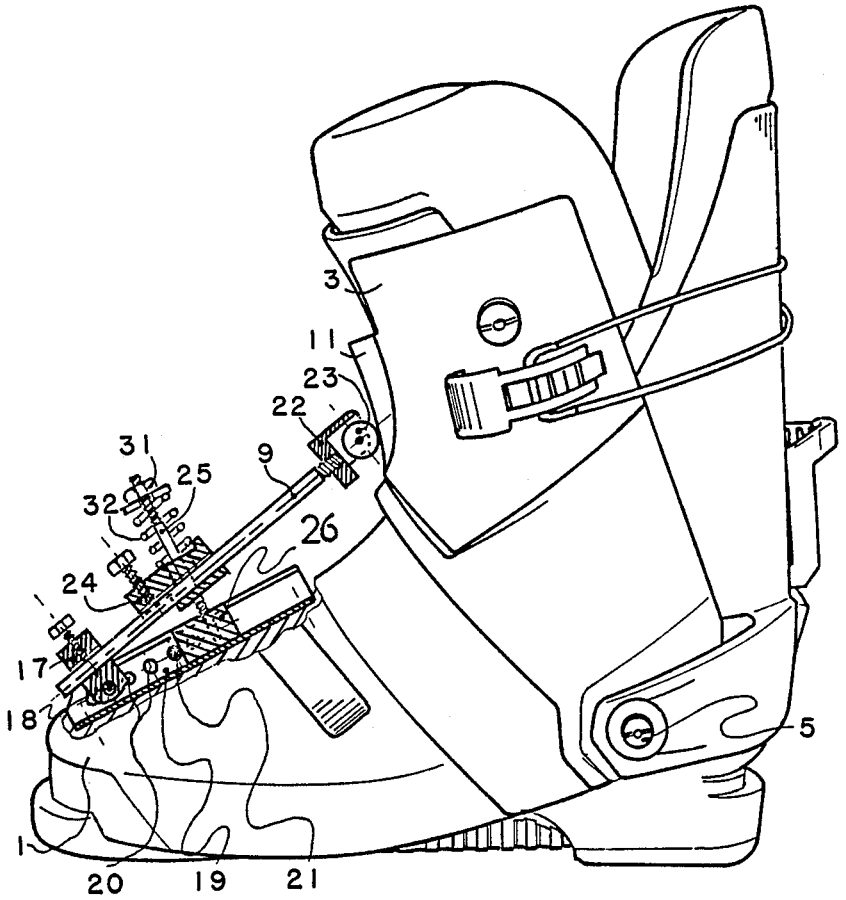
FIG. 5 shows a fourth embodiment of the invention.

FIG. 5 illustrates another embodiment. The flexion element 9 is in the form of a rod one of whose ends is made solid, in a manner adjustable in length, e.g., by contact screw, with a body 17 articulated about a transverse axis 18 on the shell base 1. The shell base 1 may carry a trough-like guide rail 19 whose sides have a series of holes 20 spaced according to the length and adapted to receive pins 21 one of which serves as a transverse articulation axis 18. The other end of the flexion element 9 carries a cap 22 in which is mounted a roller 23 which cooperates by sliding or rolling contact with a ramp 11 of the cuff 3. The cap 22 may be adjustable in position, e.g., by means of a screw-nut system.

The operation is simliar to that which was previously described. However, beyond the effect of the adjustment of the length of the flexion rod 9 through the position of the articulation axis 18 in the rail 19, or of the articualted body 17, or of the cap 22, with respect to the rod 9, a supplemental device makes it possible also to act on the stiffness characteristics. It comprises a slider 24 which is displaceable and stoppable in position along the rod 9, e.g., by means of a contact screw, and leaving a rod 25 which is approximately perpendicular to the flexion rod 9 and cooperating by a screw threading with a sliding block 26 which is adjustable and which can be stopped in position by one of the pins 21 in the trough-like rail 19. The head of this rod 25 carries a nut 31 regulating the compression force of a spring 32 or other resilient body supported on the slider 24. One thus obtains a tightening of the flexion rod 9, adjustable in position and intensity, which can effect the stiffness characteristics of the articulation of the cuff 3 on the shell base 1.

Figure 6:
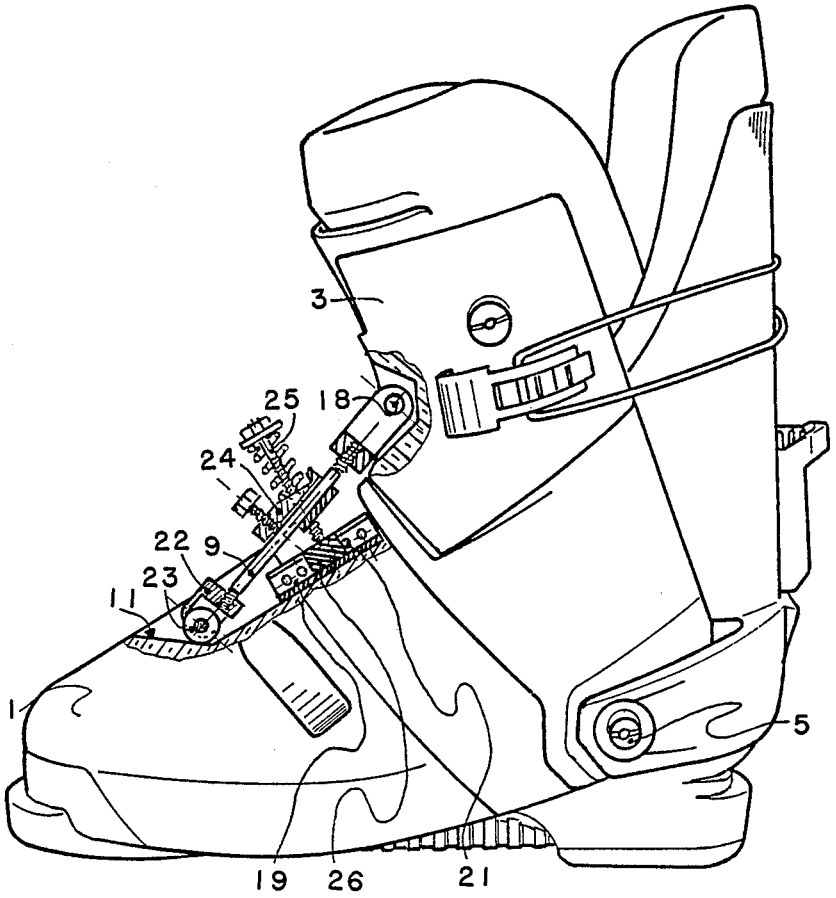
FIG. 6 shows a variant of the embodiment of FIG. 5.

FIG. 6 illustrates a variant of the preceding device. The flexion rod 9 with the same length adjustment possibilities is articulated 18 this time on the cuff 3, and the roller 23 in the cap 22 cooperates in rolling and/or sliding contact with the ramp 11 carried by the shell base 1. The slider adjustment device 24 to 26 is identical with the preceding one except as regards the rail 19, which is shorter, which is no longer required to carry the transverse axis of articulation.

Figure 7:
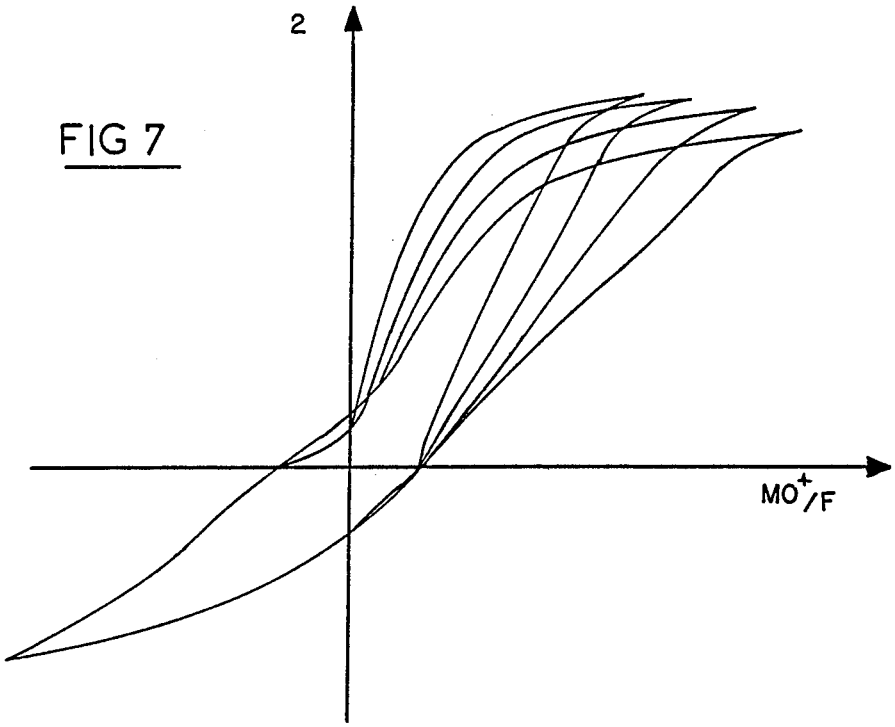
FIG. 7 is a diagram of flexion curves obtained with the device of FIG. 5, and FIG. 8 an enlarged view of this FIG. 5.
Figure 8:
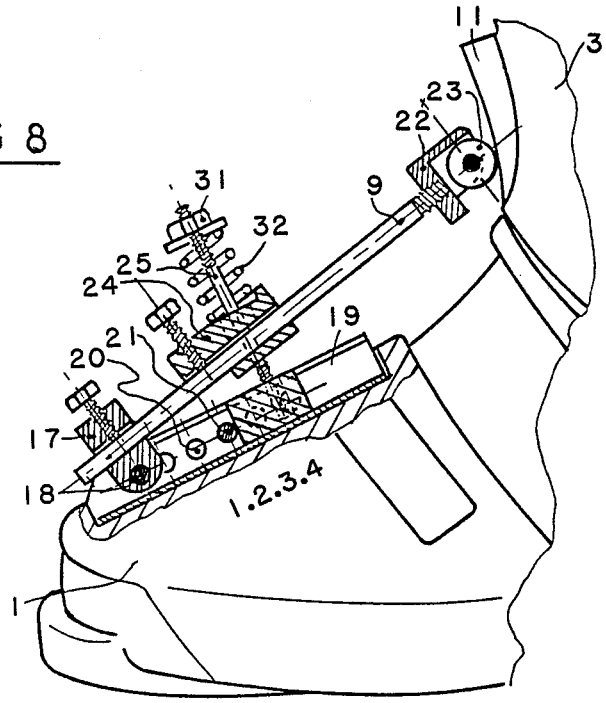

FIG. 8 shows, in larger scale, the device of FIG. 5, with an indication of the successive adjustment positions (1, 2, 3, 4), and FIG. 7 shows the stiffness curves obtained according to these adjustment positions.

Figure 9:
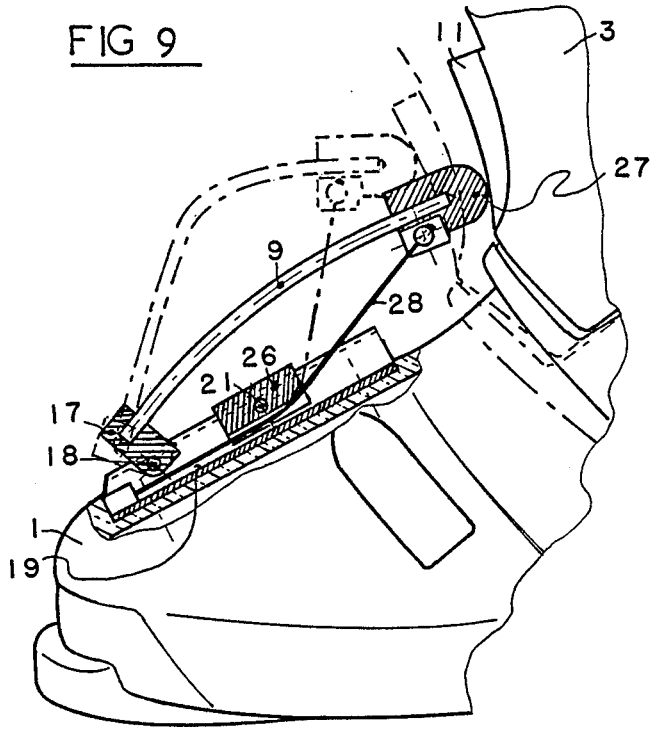
FIG. 9 shows a fifth embodiment of the device according to the invention.
Figure 10:
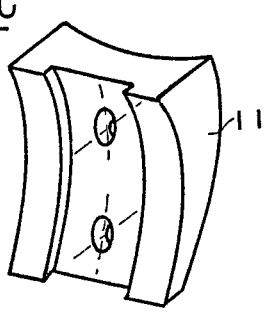
FIGS. 10, 11 and 12 show various interchangeable profile shapes, usable with the devices according to the invention.
Figure 11:
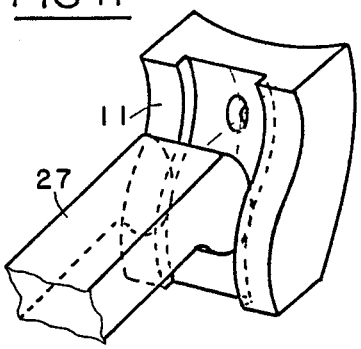
Figure 12:
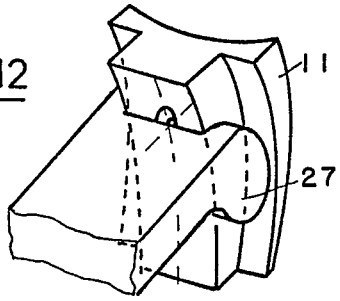

The device shown in FIG. 9 has a little in common with the preceding one, one of the ends of the flexion element 9 being articulated 18 on the shell base 1 by a body 17, and the other cooperating through contact with a ramp 11 carried by the cuff 3. The flexion element 9 is in the form of a rod or bar, preferably of composite material. The end cooperating with the ramp 11 carries a separate slide block 27. Various forms of ramps 11 are here also possible, and can be designed so as to be interchangeable. Several of these forms, as well as those of slide blocks 27 corresponding thereto, are shown in FIGS. 10, 11 and 12.

An adjustment of the stiffness characteristics of the device is here also possible, and may be analogous to the preceding ones. Another solution is shown. The shell base 1 carries a trough-like rail 19 on which is articulated 18, as in certain preceding cases, the flexion element 9. A cable 28 is anchored on the one hand on the rail 19 toward the front of the shell base, and on the other hand on the slide block 27. This cable 28 may be tightened in adjustable position on the rail 19, e.g., by means of a pin 21, through a sliding block 26 carried in the rail 19. In the displacements in flexion of the element 9, shown in dot-dash lines in the drawing, the tension of the cable 28 provides an adjustable stiffness characteristic which is added to the one belonging to the flexion rod 9.

Figure 13:
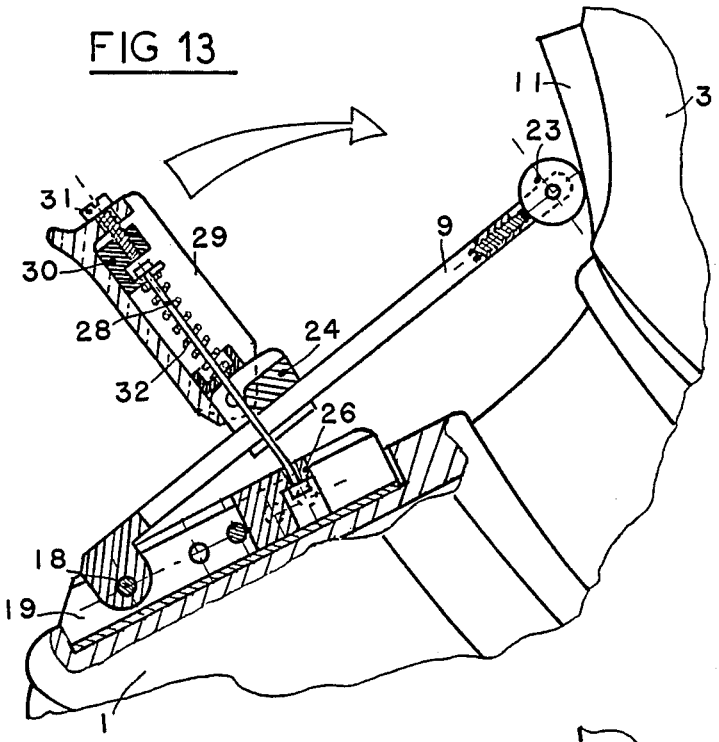
FIGS. 13 and 14 respectively illustrate, in open and closed positions, another example of the device according to the invention.
Figure 14:
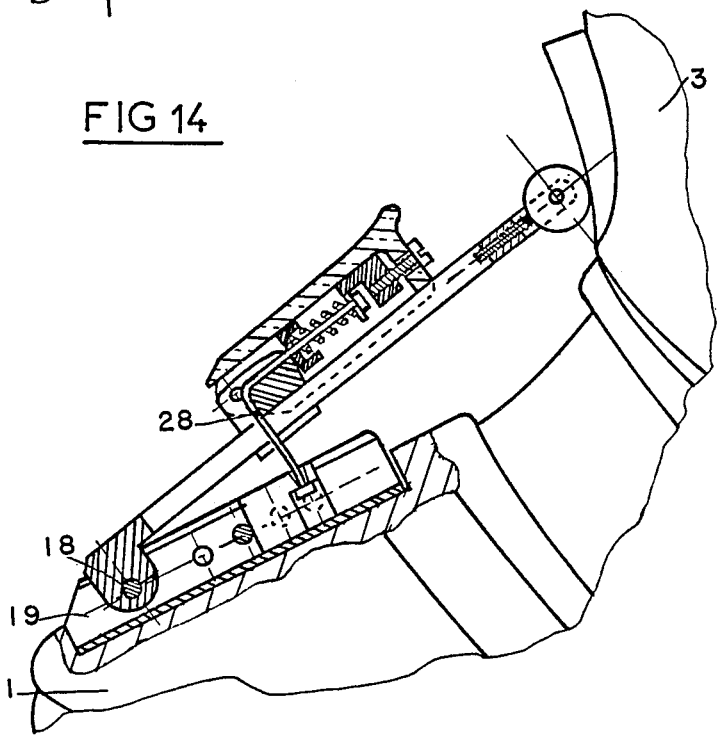

In the embodiment shown in FIGS. 13 and 14, most of the elements of the device according to FIG. 5 can be found. This device, already described, has the disadvantage of being relatively awkward, and thus integrates rather poorly with the profile of the boot. The variant now being described resolves this problem by providing for folding of the means for adjusting the stiffness by tightening of the flexion element 9. The flexion element 9 is here directly articulated 18 on the rail 19. A lever 29 articulated about a transverse axis is mounted on the slider 24. For the preceding rod 25 is substituted a cable 28 one of whose ends is anchored to the sliding block 26 in the rail 19, and the other to a second sliding block 30 at the interior of the lever 29. The position of this second sliding block 30 is adjustable by a screw 31 against a compression spring 32 or other resilient element. This arrangement enables an adjustment analogous to that obtained with the one of FIG. 5, but in addition, through a toggle-joint effect, the lever 29 in selected position of adjustment can be brought to a stable closed position, according to the arrow in FIG. 13, so as to be in the folded state shown in FIG. 14.

Figure 15A:
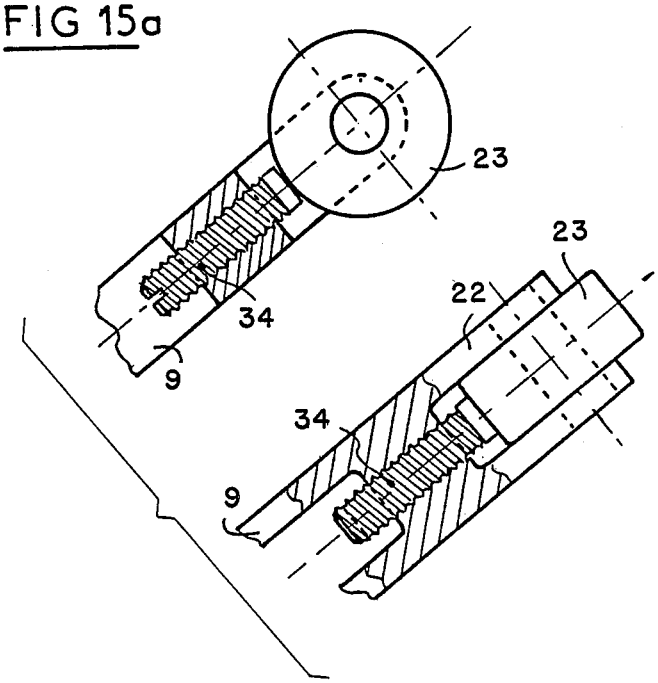
FIG. 15 shows another variant embodiment and FIG. 15*a* a constructional detail possible for the part encircled in FIG. 15.
Figure 15:
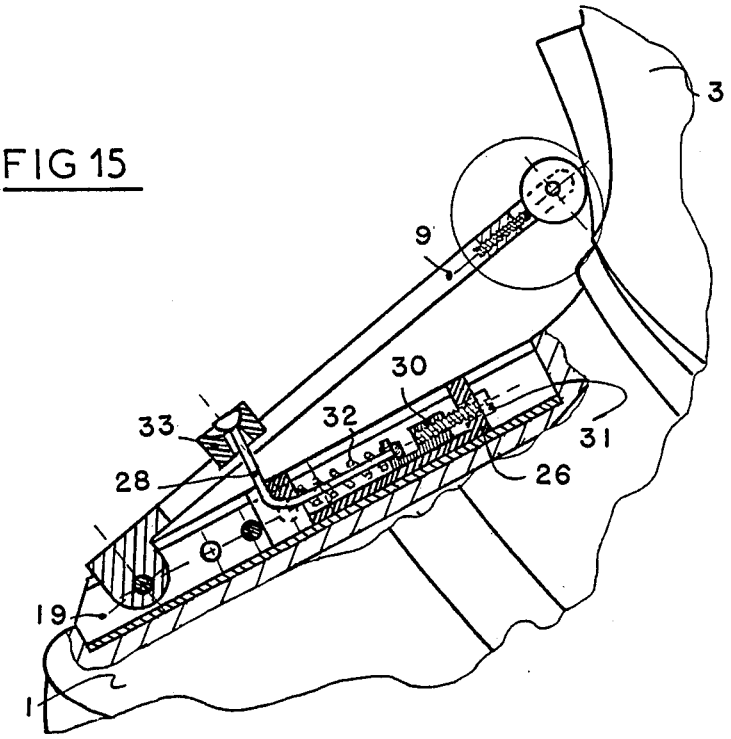

With a view to integration of the device with the architecture of the boot, and hence with its aesthetics, FIG. 15 shows a more unobtrusive variant. The traction cable 28 is anchored, on the one hand on the flexion element 9 or a piece 33 fixed on the latter with the eventual possibility of adjustment in position, and, on the other hand, to a second sliding block 30 housed in a first sliding block 26 in the rail 19 against the force of a compression spring 32. The tension of the spring 32 is adjustable by a screw 31 enabling adjustment of the position of the second sliding block 30 in the first sliding block 26.

An additional step in controlling the stiffness of the boot can be made in the devices described above by playing upon the coefficient of friction of the end of the flexion element 9 or of the roller 23 or of the slide block 27 on the cam ramp or track 11. FIG. 15*a* shows an example applicable particularly to the device of FIG. 15, according to two views in orthogonal planes. The end of the flexion bar 9 is so arranged as to enable at least one screw 34 to brake the rotation of the roller 23 in its cover 22, thereby inducing dampening of the flexion pulls from the cuff 3.

Figure 16:
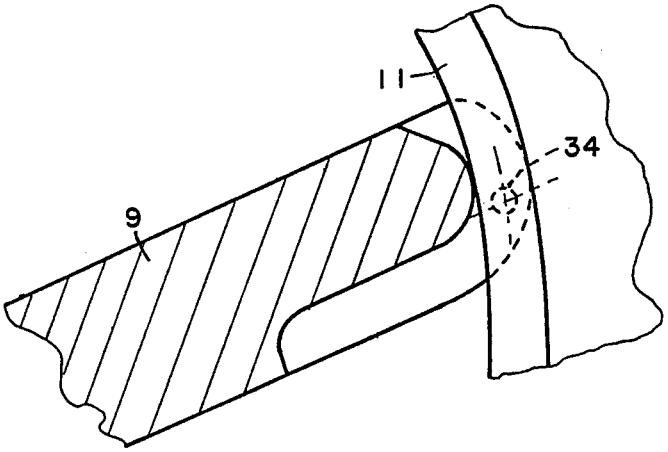
FIGS. 16 and 17 show constructional details which can be implemented in connection with the invention.
Figure 17:
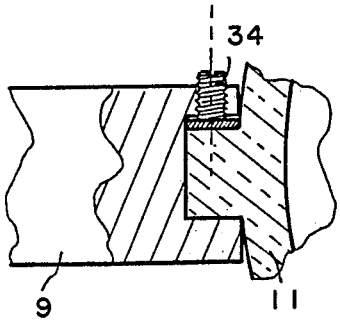

FIGS. 16 and 17 show a related solution for the adjustment of the friction of the end of the flexion element 9 on the ramp 11 by means of a screw 34 which can act on this ramp directly or through the intermediary of a friction plate. This arrangement does not call for particular comments, and it is clear that numerous equivalent techniques can be put into practise without special effort by one skilled in the art.

From the preceding description of a certain number of embodiments of the invention, it can be seen that other variants sharing the same principle are possible, particularly by modifying certain elements, by substituting equivalents for them, and by reversing to the extent possible the respective parts played by the shell base and the cuff, and the elements belonging to them.

We claim:

1. Device continuously for controlling the flexion stiffness of a ski boot comprising a shell base (1) carrying an upper composed of a flexion element (9) located in the longitudinal direction between the shell base (1) and a cuff (3) fixedly attached at only one end (10) on one of said shell base (1) and cuff (3) and whose other end cooperates in freely sliding contact with a cam ramp or track (11) carried by the cuff (3) or the shell base (1), respectively.

2. Device according to claim 1, wherein the flexion element (9) is a strip embedded (10) at one end on the shell base (1) and whose free end is in sliding contact with a ramp (11) carried by the cuff.

3. Device according to claim 1, wherein the flexion element (9) is a strip embedded (10) at one end on the cuff (3) and whose free end is in sliding contact with a ramp (11) carried by the shell base (1).

4. Device according to any one of claims 1 to 3, including a slide device (15) adjustable in position from the point of attachment (10) and enabling pinching of the flexion element (9) respectively against the shell base (1) or the cuff (11) or tightening it to vary its effective operating length, and hence its stiffness characteristics.

5. Device according to any one of claims 1 to 3, wherein the regions of the shell base (1) and/or the cuff (3) serving for fastening and/or movable contact are protected by a cover (12, 13).

6. Device according to claim 1, wherein the flexion element (9) is in the shape of a turning fork embedded (10) by its base on the shell base and having its branch ends in both longitudinal and transversal sliding contact with a ramp (11) carried by the cuff (3).

7. Device according to claim 6, wherein a slide device (15) adjustable in position from the embedding point (10) permits pinching of the branches of the turning fork (9) against a longitudinal abutment (16) carried by the shell base (1).

8. Device according to claim 1, wherein the flexion element (9) is attached to the shell base (1) by an articulation about a transverse axis (18).

9. Device according to claim 1, wherein the flexion element (9) is attached to the cuff (3) by an articulation about a transverse axis (18).

10. Device according to claim 8 or claim 9, wherein the distance separating the point of articulation (18) and the point of contact on the ramp (11) is adjustable.

11. Device according to claim 10, wherein the flexion element (9) carries a slider (24) of adjustable position cooperating with a sliding block (26) adjustable in position and carried by the shell base (1) to enable tightening of the flexion element (9).

12. Device according to claim 11, wherein the tightening tension of the flexion element (9) is adjustable by a screw (31) and spring (32) device.

13. Device according to claim 11 or claim 12, wherein the slider (24) cooperates with the sliding block (26) through the intermediary of a rod (25).

14. Device according to claim 11 or claim 12, wherein the slider (24) cooperates with the sliding block (26) through the intermediary of a traction cable (28).

15. Device according to claim 11, wherein the sliding block (26) is displaceable along a longitudinal rail (19) carried by the shell base (1) and having means (20, 21) permitting its stopping in place.

16. Device according to claim 14 or claim 15, wherein the slider (24) carries a lever (29) articulated about a transverse axis and to which is attached the traction cable (28) in such manner as to constitute a toggle joint.

17. Device according to claim 16, wherein the attachment of the cable (28) to the lever (29) is made through the intermediary of a sliding block (30) movable in the lever (29) against a spring (32).

18. Device according to claim 8, wherein, the flexion element (9) carries an anchor (33) for a cable (28) whose other end is anchored to a sliding block (26) adjustable in position (30) on the shell base (1) to enable tightening of the flexion element (9).

19. Device according to claim 18, wherein the tightening tension of the flexion element (9) is adjustable by a screw (31) and spring (32) device.

20. Device according to claim 1, wherein the flexion element (9) carries in the vicinity of its end in contact with the ramp (11) the anchor for a traction cable (278) whose other end is anchored on the shell base (1) or the cuff (3) in the vicinity of the transverse articulation axis (18).

21. Device according to claim 20, wherein the tension of the cable (28) is adjusted by displacement of a sliding block (26) adjustable in position in the shell base (1).

22. Device according to claim 21, wherein the sliding block (26) is displaceable in a rail (19) carried by the shell base (1) and has means (20, 21) permitting its stopping in place.

23. Device according to claim 1, wherein the ramp (11) is an interchangeable part.

24. Device according to claim 1, wherein the end of the flexion element (9) in contact with the ramp (11) is in the form of a slide block (27).

25. Device according to claim 24, including means (33) enabling adjustment of the coefficient of friction between the slide block (27) and the ramp (11).

26. Device according to claim 1, wherein, the contact between the end of the flexion element (9) and the ramp (11) is made through the intermediary of a roller (23).

27. Device according to claim 26, including means which allow braking the rolling of the roller (23) on the ramp (11) in an adjustable manner.

* * * * *